US006701695B1

(12) United States Patent
Douglas

(10) Patent No.: US 6,701,695 B1
(45) Date of Patent: Mar. 9, 2004

(54) PACKAGING MACHINE FOR PRODUCING RECLOSABLE PACKAGES

(76) Inventor: Brian Douglas, 25 Charissa Ct., Hewitt, NJ (US) 07421

( * ) Notice: Subject to any disclaimer, the term of this patent is extended or adjusted under 35 U.S.C. 154(b) by 0 days.

(21) Appl. No.: 10/124,996

(22) Filed: Apr. 18, 2002

(51) Int. Cl.[7] ..... B65B 31/02; B65B 47/06; B65B 61/18

(52) U.S. Cl. ..... 53/511; 53/133.4; 53/561; 53/329.3; 156/66

(58) Field of Search ..... 53/559, 561, 453, 53/510, 511, 432, 433, 412, 133.4, 133.3, 139.2, 329.3; 156/66

(56) References Cited

U.S. PATENT DOCUMENTS

| | | | | | |
|---|---|---|---|---|---|
| 3,038,225 | A | | 6/1962 | Ausnit | |
| 3,198,228 | A | | 8/1965 | Naito | |
| 3,554,822 | A | * | 1/1971 | Schwarzkopf | 156/66 |
| 3,732,663 | A | * | 5/1973 | Geldmacher | 53/412 |
| 3,948,705 | A | * | 4/1976 | Ausnit | 493/213 |
| 4,296,588 | A | | 10/1981 | Vetter | |
| 4,437,293 | A | | 3/1984 | Sanborn, Jr. | |
| 4,589,145 | A | | 5/1986 | Van Erden et al. | |
| 4,782,951 | A | | 11/1988 | Griesbach et al. | |
| 4,876,842 | A | | 10/1989 | Ausnit | |
| 4,957,571 | A | * | 9/1990 | Cipolla | 156/66 |
| 4,969,309 | A | * | 11/1990 | Schwarz et al. | 53/412 |
| 5,105,603 | A | | 4/1992 | Natterer | |
| 5,118,203 | A | | 6/1992 | Andronico | |
| 5,163,269 | A | * | 11/1992 | Williams | 53/412 |
| 5,198,055 | A | | 3/1993 | Wirth et al. | |
| 5,412,924 | A | | 5/1995 | Ausnit | |
| 5,425,216 | A | | 6/1995 | Ausnit | |
| 5,551,208 | A | | 9/1996 | Van Erden | |
| 5,561,966 | A | * | 10/1996 | English | 53/412 |
| 5,747,126 | A | | 5/1998 | Van Erden et al. | |
| 5,832,570 | A | | 11/1998 | Thorpe et al. | |
| 5,875,611 | A | | 3/1999 | Plourde | |
| 5,930,877 | A | | 8/1999 | Thorpe et al. | |
| 5,941,643 | A | | 8/1999 | Linkiewicz | |
| 5,956,924 | A | * | 9/1999 | Thieman | 53/412 |
| 6,030,122 | A | | 2/2000 | Ramsey et al. | |
| 6,044,621 | A | | 4/2000 | Malin et al. | |
| 6,138,436 | A | | 10/2000 | Malin et al. | |
| 6,138,439 | A | | 10/2000 | McMahon et al. | |
| 6,185,907 | B1 | | 2/2001 | Malin et al. | |
| 2002/0015537 | A1 | | 2/2002 | Strand et al. | |

OTHER PUBLICATIONS

Welcome to the World of Multivac Packaging Machines Sales Catalog © 1988 pp. 8–15.

* cited by examiner

*Primary Examiner*—Stephen F. Gerrity
(74) *Attorney, Agent, or Firm*—Siegmar Silber, Esq.

(57) ABSTRACT

A form-fill-and-seal (FFS) packaging machine is described wherein a zipper is attached to the package simultaneously with the sealing operation at the sealing and evacuation station. The attached zipper is thereafter welded in place at the zipper welding and cutting station. A zipper blank feeder and a channel-forming die with an impulse sealer are integrated into the sealing die of a packaging machine forming a combination work station. The zipper is installed at an existing work station and shares the existing lifting device. This enables the retrofitting of an FFS packaging machine to include a zipper attachment function without changing the footprint thereof. The combination work station forms a channel for the zipper blank between the thermoformed web and the lidstock. While the sealing die is providing a seal about the lid, the impulse sealer in the channel-forming die attaches the zipper to an initial attachment portion of the packaging film. Upon completion of the package, this initial attachment portion, if retained, becomes the tamper-indication portion of the package. Both the sealing and evacuation station and the zipper welding stations of this invention are of jacketed construction enabling the temperature control of the zipper blank throughout the installation procedures.

18 Claims, 5 Drawing Sheets

PACKAGING MACHINE FOR PRODUCING RECLOSABLE PACKAGES

BACKGROUND OF THE INVENTION

1. Field of the Invention

This invention relates to a packaging machine for producing reclosable packages, and more particularly, to a sealing station and a welding station for installing resealable closures or zippers onto packages produced on a form-fill-and-seal (FFS) packaging machine. The invention further relates to retrofitting horizontal FFS packaging machines to incorporate the zipper installing function.

2. Background Information

The formation of packages on form-fill-and-seal machines takes many forms. There is a spectrum of form-fill-and-seal packaging machines which extends from horizontal and vertical bag-forming machines which form packages from a single web of packaging material to rollstock machines which form packages by sealing an upper web to a formable lower web. Such machines package an unending array of consumable goods, including food products, non-food products, and medical products.

While the sealing and channel-forming die assembly of this invention may be broadly applicable to packaging machines, the information herein is presented in the milieu of a horizontal, rollstock form-fill-and-seal machine, especially those which provide for packaging of products in a vacuum or a modified atmosphere. These machines make thermoformed packs which are most commonly used for foods, such as sliced meats and cheeses. A further consideration here is seal integrity and this becomes critical as such products most often require vacuum or modified atmosphere packing.

In recent years many thermoformed packages are popularly supplied with primary and secondary closures, one of which is resealable. The resealable closures, commonly known as sealable profiles or zippers, have been marketed under such trademarks as Fresh-Loc and Zip-Pac. While the resealable closure has wide consumer acceptance, the requisite machine adaptation to the rather bulky closure (as compared to film) has been problematic. Typically because of their geometry and other inherent problems, the incorporation of resealable closures into a package frequently creates wrinkles in one packaging film or the other resulting in incompletely sealed packages. These incompletely sealed packages or leakers, in which a loss of seal integrity is experienced, are frequently not detectable by the quality control of the packager, but become apparent later in the distribution channel. When packaged goods without seal integrity get to the marketplace or into the consumer's hands, such goods have a reduced shelf life or experience spoilage.

In the past, horizontal FFS machines installed zippers at a separate working station between the forming station and the evacuation and sealing station. The zipper installing work station had a dedicated lifting device associated therewith. The zippers provided in the form of spooled zipper blanks, when exposed to the high temperatures of the zipper installation stations, tended to twist out of alignment becoming difficult to manage and frequently causing the wrinkling of the packaging film described hereinabove.

The following patents are known to the inventors and are presented for the further discussion of the prior art:

| | Inventor (Assignee) | Issue Date |
|---|---|---|
| patent application 20020015537 | Strand et al. (Sargento) | Feb. 7, 2002 |
| Patent | | |
| 6,185,907 | Malin et al. (ITW) | Feb. 13, 2001 |
| 6,138,439 | McMahon et al. (ITW) | Oct. 31, 2000 |
| 6,138,436 | Malin et al. (ITW) | Oct. 31, 2000 |
| 6,044,621 | Malin et al. (ITW) | Apr. 04, 2000 |
| 5,941,643 | Linkiewicz (Triangle Pkg) | Aug. 24, 1999 |
| 5,930,877 | Thorpe et al. (ITW) | Aug. 03, 1999 |
| 5,832,570 | Thorpe et al. (ITW) | Nov. 10, 1998 |
| 5,747,126 | Van Erden et al. (ITW) | May 05, 1998 |
| 5,551,208 | Van Erden (ITW) | Sep. 03, 1996 |
| 5,425,216 | Ausnit (ITW) | June 20, 1995 |
| 5,412,924 | Ausnit (ITW) | May 09, 1995 |
| 5,198,055 | Wirth et al. (Alcoa) | Mar. 30, 1993 |
| 5,118,203 | Andronico (J.W. Kutter, Inc. | June 2, 1992 |
| 5,105,603 | Natterer (Multivac) | Apr. 21, 1992 |
| 4,876,842 | Ausnit (ITW) | Oct. 31, 1989 |
| 4,782,951 | Griesbach et al. (Oscar Mayer) | Nov. 08, 1988 |
| 4,589,145 | Van Erden et al. (ITW) | May 13, 1986 |
| 4,296,588 | Vetter (Multivac) | Oct. 27, 1981 |
| 4,240,241 | Sanborn (W.R. Grace & Co.) | Dec. 23, 1980 |
| RE.28,969 | Kakuji Naito | Sep. 21, 1976 |
| 3,038,225 | S. Ausnit (ITW) | June 12, 1962 |

The development of technology in the consumer goods and food packaging area is driven by three distinct technologic/economic forces, namely, (1) manufacturers of goods/food producers requirements; (2) packaging film/zipper blank innovation; and, (3) packaging machine development. In the first category, the patent application assigned to Sargento Foods, Inc., U.S. patent application Ser. No. 20020015537; and the patent assigned to Oscar Mayer Foods Corporation, U.S. Pat. No. 4,782,951 are primary examples. In the packaging film innovation area, the patents assigned to Reynolds Consumer Products, U.S. Pat. No. 5,198,055 and to W. R. Grace & Co., Cryovac Division, U.S. Pat. Nos. 4,240,241 and 4,437,293 are discussed.

In the following, it is seen that the prior art packaging machine patents arise from two main streams of technological development, namely, the Illinois Tool Works, Inc., Glenview, Ill. products and the Multivac Sepp Haggenmuller KG, Wolfertschwenden, West Germany, (Multivac) products. The Illinois Tool Works line includes the Minigrip, Inc. technology, which corporation is now part of Illinois Tool Works, Inc. It is noted that the reclosable seal patents to Griesbach et al. of Oscar Mayer Foods Corporation and Wirth et al. of Reynolds Consumer Products, Inc., are related to the Multivac technology.

U.S. patent application Ser. No. 20020015537—Strand et al. (Sargento Foods, Inc.)—Feb. 7, 2002

This application describes a resealable bag for a food product which is manufactured by an HFFS packaging machine such as described in Sanborn, U.S. Pat. No. 4,240,241 (W. R. Grace & Co.) and also has a tamper-evident seal.

U.S. Pat. No. 6,138,439—McMahon et al. (ITW)—Oct. 31, 2000

The patent describes an HFFS packaging machine which mounts a zipper to film extensions of an already sealed package at a zipper and slider insertion and attaching station dedicated. After installation of the zipper, a slider is separately inserted into the assemblage.

U.S. Pat. No. 5,198.055—Wirth et al.—Mar. 30, 1993

Wirth et al. discloses a method of forming a reclosable package using special profile strips (zipper components), the strips and a resulting package. The profile strips have a flange element which includes, by being a thickened element or by adding a buffer strip thereto, a thermal barrier. The barrier is designed to prevent the flanges from fusing together during the installation step of flange-film sealing.

U.S. Pat. No. 5,118,203—Andronico, D. (T. W. Kutter, Inc.)

The apparatus of this invention is an HVFFS Tiromat 3000 manufactured by Kramer & Grebe (Canada) Ltd., Waterloo, Ontario, which employs a zipper application assembly prior to the forming, filling and sealing functions.

U.S. Pat. No. 5,105,603—Natterer, J. (Multivac)—Issued Apr. 21, 1992

The patent to Natterer describes a rollstock HVF-F-S packaging machine having a work station dedicated to applying the closure strip to the lower formable web prior to entering the sealing and evacuation where the package is mated with the lidstock, evacuated and sealed. The work station for applying the closure strip is not temperature controlled.

U.S. Pat. No. 4,782,951—Griesbach et al.—Nov. 8. 1988

The patent to Griesbach et al. discloses a resealable package having interlocking closure strips outside of a hermetic seal. The seal is of a peelaway type so as not to destroy the integrity of the package upon opening of the package.

Griesbach et al. discloses a reclosable package comprising interlocking closure strips positioned outside of a hermetic seal or seal area and the method for producing same. The hermetic seal is of the easy-open or peelaway type so as to not destroy the integrity of the package or closure strips upon opening of the package.

U.S. Pat. No. 4,296,588—Vetter (Multivac)

This patent discloses a sealing station for a HVFSS which provides a deflector to divert the air and moisture removed from the product-containing receptacle and thereby improve the vacuum achieved during the evacuation cycle.

U.S. Pat. No. 4,240,241—Sanborn, P. A. (W. R. Grace & Co.) Dec. 23, 1980

The patent describes a thermoform machine for packaging a product in a reclosable package in a straight through process on a single machine rather than making a reclosable pouch on one machine and performing the filling, evacuating and sealing process on another machine.

U.S. Pat. No. Re.: 28,969—K. Naito—Sep. 21, 1976

The patent discloses a reclosable plastic bag having interlocking rib and groove elements integral with the plastic of the bag with the elements being designed so that the bag opens easily from the outside, but resists opening from the inside.

U.S. Pat. No. 4,876,842—Ausnit—Oct. 31, 1989

A method of and apparatus for packaging product masses in a form, fill and seal machine, wherein a continuous length of packaging film is joined in running relation by a continuous length of separately formed plastic reclosable fastener assembly having interlock profile strips spot sealed together at package length intervals. The corunning fastener strip assembly and the packaging film are oriented so that the spot seals of the strip are located in alignment with the spaces between the product masses on the film to assure that the fastener strip assembly will be cross sealed at the spot seals when the film is cross sealed between the product masses to provide individual packages. The orienting may be effected by an indexing arrangement including sensor response to index marks on the film and the fastener assembly.

In reviewing the prior art as described hereinabove, the zipper installation procedures are not conducted at the sealing station simultaneously with the sealing and/or evacuation functions. Present zipper installation procedures frequently interfere with package integrity. It is not taught how to sufficiently isolated the zipper installation from the sealing function so as to avoid the introduction of air into product receptacles, thereby reducing product shelf life and the overall quality of the packaged goods. Unlike what is known to date, in the disclosure which follows, it is taught how the sealing and evacuation function, is combined at the work station with zipper blank feeding and tacking function. Moreover, the teaching includes how to stabilize the zipper blank during processing by controlling the temperature conditions under which installation takes place. The submission of the above list of documents is not intended as an admission that any such document constitutes prior art against the claims of the present application. Applicant does not waive any right to take any action that would be appropriate to antedate or otherwise remove any listed document as a competent reference against the claims of the present application.

SUMMARY

In general terms, the invention disclosed hereby is a form-fill-and-seal (FFS) packaging machine wherein a resealable closure or zipper is attached to the package simultaneously with the sealing station operation of the packaging machine and thereafter is welded in place at the zipper welding station. For this function, a zipper blank feeder and a channel-forming die with an impulse sealer are integrated with the sealing die of a packaging machine, which combination forms an improved working station that is utilizable with a broad spectrum of FFS machines. Because the packaging machine, when modified with the present invention, installs the zipper to the package at an existing working station, an additional lifting device is not required. This enables the retrofitting of FFS packaging machines to include a zipper attachment function without changing the footprint of the packaging machine.

The sealing and channel-forming assembly of this invention creates an aperture between and a pathway through two layers of packaging film (on a horizontal FFS packaging machine, between a thermoformed lower web and a lidstock or upper web) for the zipper blank. While the sealing die typically provides a perimeter seal about the lid, an impulse sealer in the channel-forming die functions cooperatively with the lift station associated with the sealing die to attach the zipper to the layers of packaging film. Upon completion of the package, this attachment portion, if retained, becomes the tamper-indication portion of the package seal.

The sealing and channel-forming assembly and the zipper welding and package cutting station of this invention are of jacketed construction enabling the temperature control of zipper blank throughout the installation procedures described hereinbelow. Installing the zipper under temperature controlled conditions facilitates the management of the zipper blank.

After passing through the sealing station, the package indexes to the the zipper welding and package cutting station. Here, the packaging films are longitudinally welded to corresponding zipper flanges and the zippers are transversely welded at both ends thereof. The package cutting operation separates the packages as required.

The present invention also is novel as it enables the retrofitting of existing packaging machine lines by, in contrast to present practice of having a working station and lift device for installation of a zipper, incorporating a zipper blank feeder and a channel-forming die with an impulse sealer into the sealing station and a zipper welding unit into the cutting station. Both the sealing station and the welding and cutting station operate under temperature-controlled conditions.

OBJECTS AND FEATURES OF THE INVENTION

It is an object of the present invention to provide in a form-fill-and-seal packaging machine, a channel-forming die for use in installing resealable closures.

It is another object of the present invention to provide a resealable closure installation device for a horizontal rollstock machine that during installation isolates the product package from the closure being installed.

It is yet another object of the present invention to provide a resealable closure installation device for a horizontal rollstock machine that during installation maintains the vacuum or modified atmosphere under which the goods are packed.

It is still yet another object of the present invention to adapt a rollstock form-fill-and-seal machine for resealable closure installation using a minimum number of lift stations.

It is another feature of the present invention that the resealable closure is installed on the package under temperature-controlled conditions.

It is a feature of the present invention that the resealable closure being installed is tacked to the packaging films at the sealing station die.

It is another feature of the present invention that the resealable closure is installed on the package without affecting the seal integrity thereof.

It is yet another feature of the present invention that the resealable closure installation device may be retrofitted to a form-fill-and-seal machine without increasing the number of lift stations.

Other objects and features of the present invention will become apparent upon reviewing the drawing and reading the detailed description which follows.

BRIEF DESCRIPTION OF THE DRAWINGS

In the drawing which follows the same parts are afforded the same reference numeral throughout the various views.

DESCRIPTION OF THE PREFERRED EMBODIMENT

The description which follows is of a two-track, horizontal vacuum form-fill-and-seal packaging machine employing the invention hereof. Further, the packaging machine is of a rollstock machine that thermoforms packs from a formable lower web and seals packs utilizing an upper web or lidstock. While the overall packaging machine is initially described, the inventive aspect of this disclosure is the attachment of the resealable closure or zipper at the evacuation and sealing station and the welding thereof at the zipper welding station.

Figure 1:
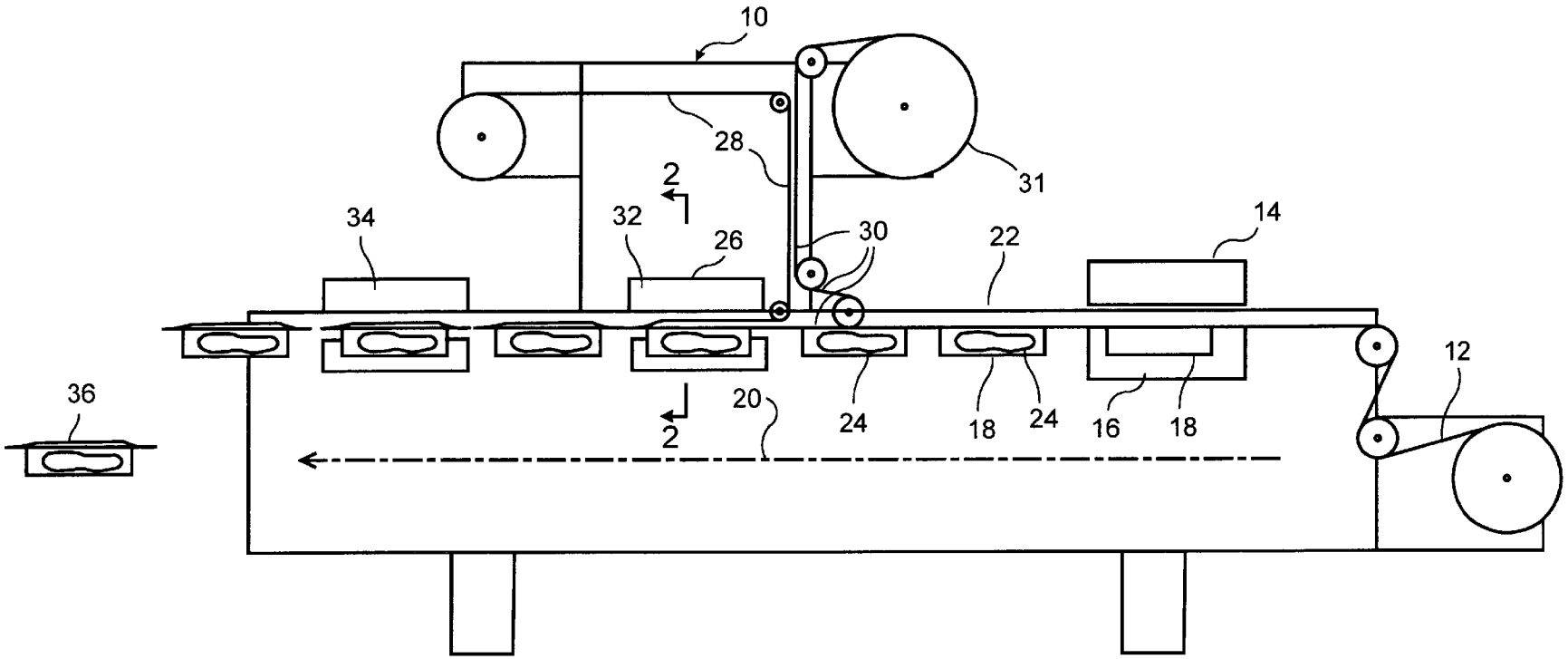
FIG. 1 is a schematic view of the horizontal vacuum form-fill-and-seal (HVFFS) packaging machine showing the improvement of the present invention.

Referring now to FIG. 1, the horizontal vacuum form-fill-and-seal packaging machine is schematically shown and is referred to generally by the reference designator 10. A roll of packaging film, also referred to as the formable lower web, 12 is fed to forming station 14 where forming die 16 applies heat thereto and forms cavities or product receptacles 18 for receiving product. Upon feeding the lower web 12 onto the machine 10, the web 12 is firmly held by gripper chains (not shown) which serve to index the packaging film 12 forward through the machine on product path 20. The product receptacles 18 are constructed to advance to the filling station 22 where product 24 is loaded into the product receptacles 18.

When indexed along the product path 20, the formed receptacles 18 with product 24 therein next reach the evacuation and sealing station 26 which is described in detail hereinbelow. Here a roll of packaging film, also referred to as the lidstock or upper web, 28 is introduced atop the formed receptacles 18 with product 24. Between the two films 12 and 28, a zipper or reclosable seal strip 30 from feeder 31 is inserted. The sealing station 26 which operates under controlled temperature conditions includes a channel-forming die 32 that isolates the vacuum or modified atmosphere packaging function from the zipper installation function. At this station, the zipper strip 30 is tacked in place.

Finally, the zipper weld and cutting station 34 is reached where the zipper or reclosable seal is securely welded and the package 36 is cut free from the web.

Figure 2:
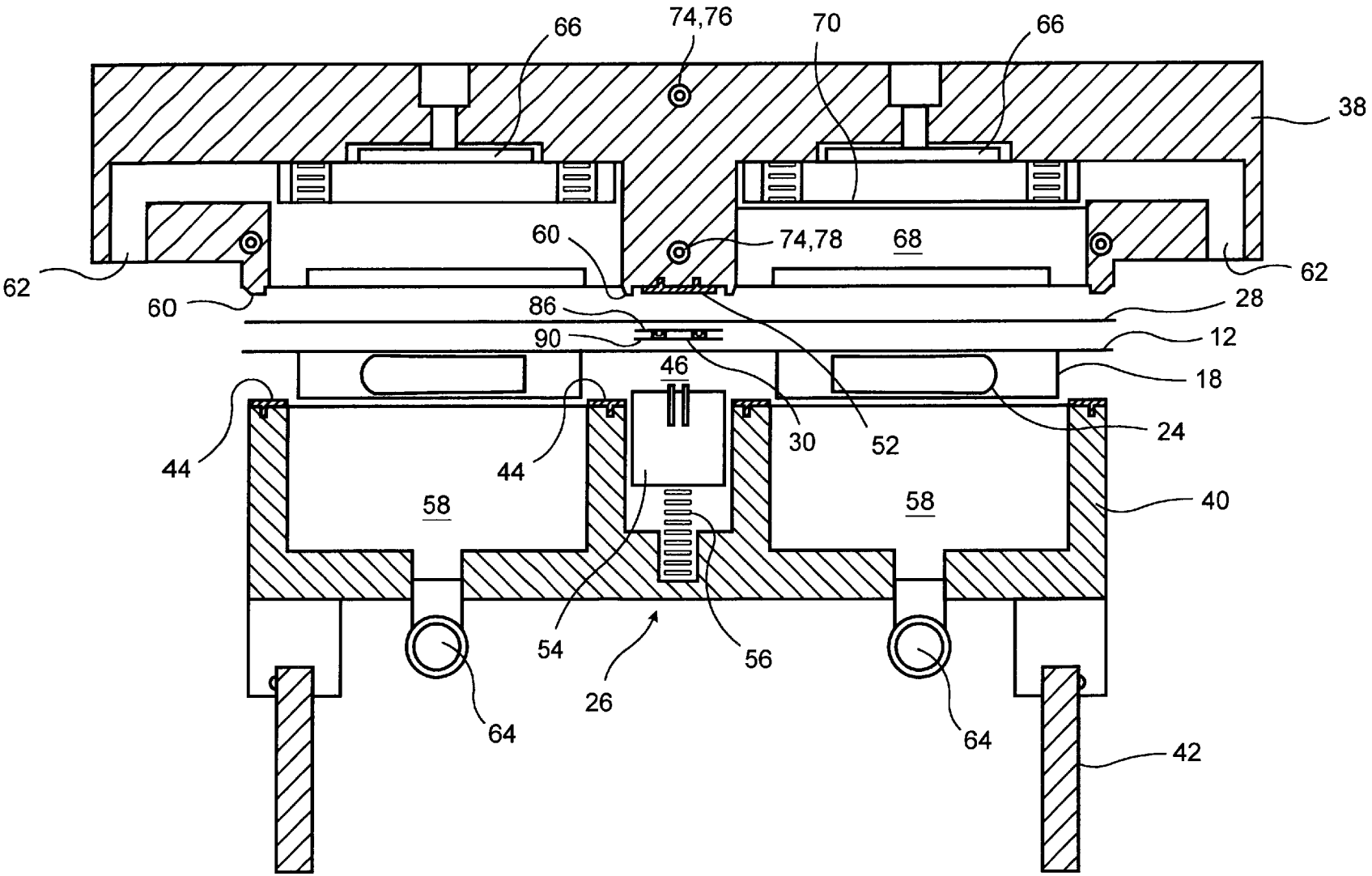
FIG. 2 is a cross-sectional view of the sealing station of the HVFFS packaging machine of FIG. 1, taken along line 2—2 thereof, showing the channel-forming die and impulse sealing unit.
Figure 3:
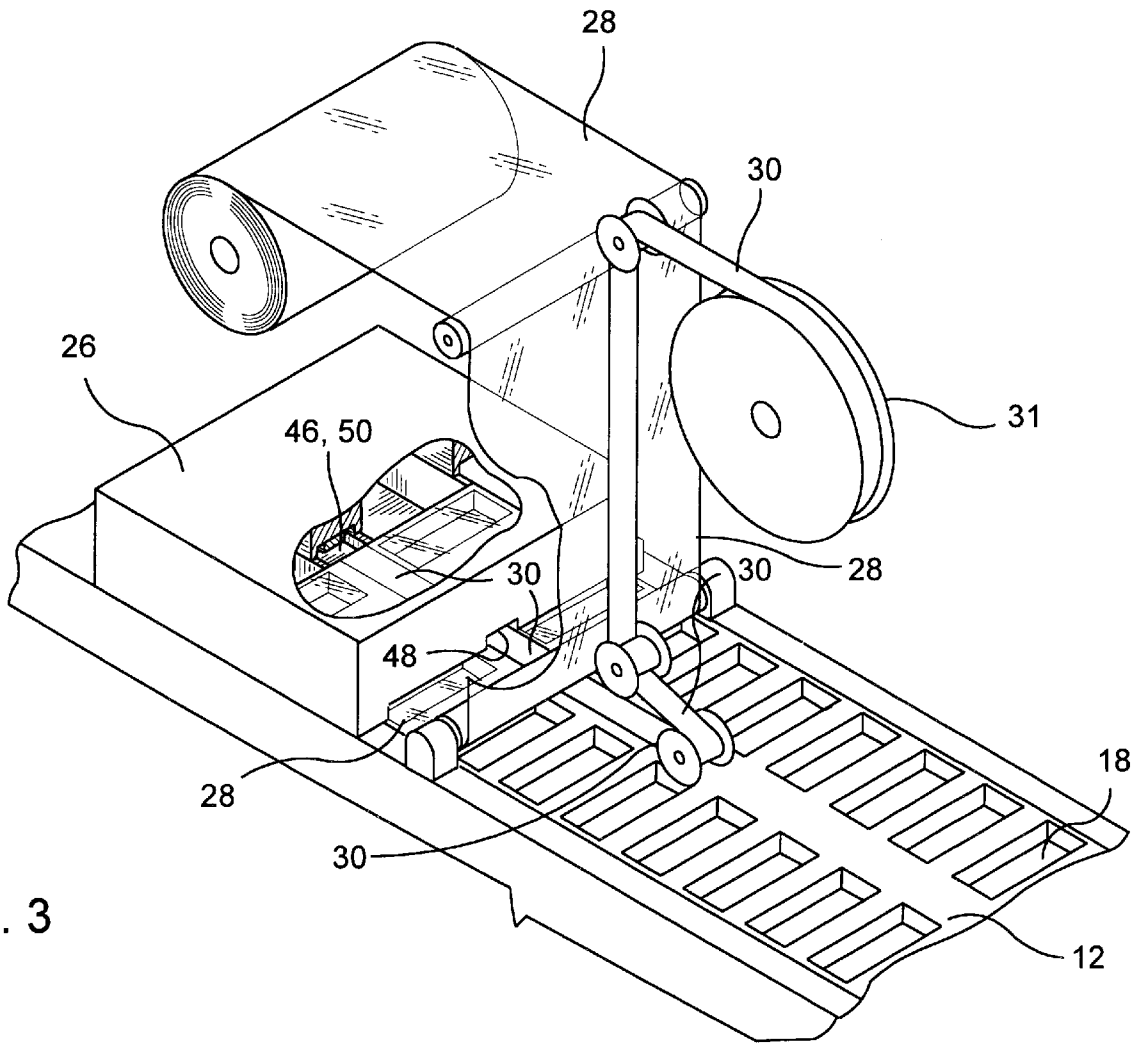
FIG. 3 is a perspective view of the sealing station of the HVFFS packaging machine of FIG. 1 with the housing thereof partially broken away to show the details of the zipper blank feed and the channel therefor.

The evacuation and sealing station 26 is shown in cross-section in FIG. 2 and in perspective in FIG. 3. The lower forming web 12 at this station has been previously formed with product receptacles 18 at forming station 14 and loaded with product 24 at filling station 22. The packaging machine 10 is constructed to index the above-described lower web assemblage 12, 18 and 24 so as to be disposed between a seal head shell 38 and a seal die shell 40. The seal head shell 38 and the seal die shell 40 are structured to move away from and toward one another between an open and a closed position as operated by the sequenced lift station (not shown) of which lift rails 42 form a part thereof. Simultaneously with the indexing of the lower web assemblage 12, 18 and 24, the packaging machine 10 is constructed to feed the upper web 28 atop the lower web 12.

In the two-track HVFFS packaging machine, there are two (or multiples of two) packages that are sealed in each machine cycle. Here there are two side-by-side, spaced apart packages which, upon the closure of the sealing die 38 and 40, clamps the perimeter of each package between silicone perimeter gasket 44 and the seal head shell 38. The two packaging films 12 and 28 in the longitudinal space between the two tracks receive zipper blank or reclosable seal strip 30. The zipper channel 46 begins at aperture 48 and extends along pathway 50 thereof. When the sealing die 38 and 40 closes, the zipper blank 30 is nipped between silicone impulse seal gasket 52 and impulse seal bar 54 under tension imparted by impulse seal bar spring 56. As mentioned above, when the sealing die 38 and 40 closes, the packaging films 12 and 28 are nipped between package perimeter seal gaskets 44 and wall 60 of sealing die 38. Further, the evacuation chamber 28 is isolated from the zipper channel-forming portion of the die 38 and 40 by perimeter wall or projection 60. This wall 60 extends from the seal head shell 38 and, during closure, engages perimeter gasket 44.

Figure 5:
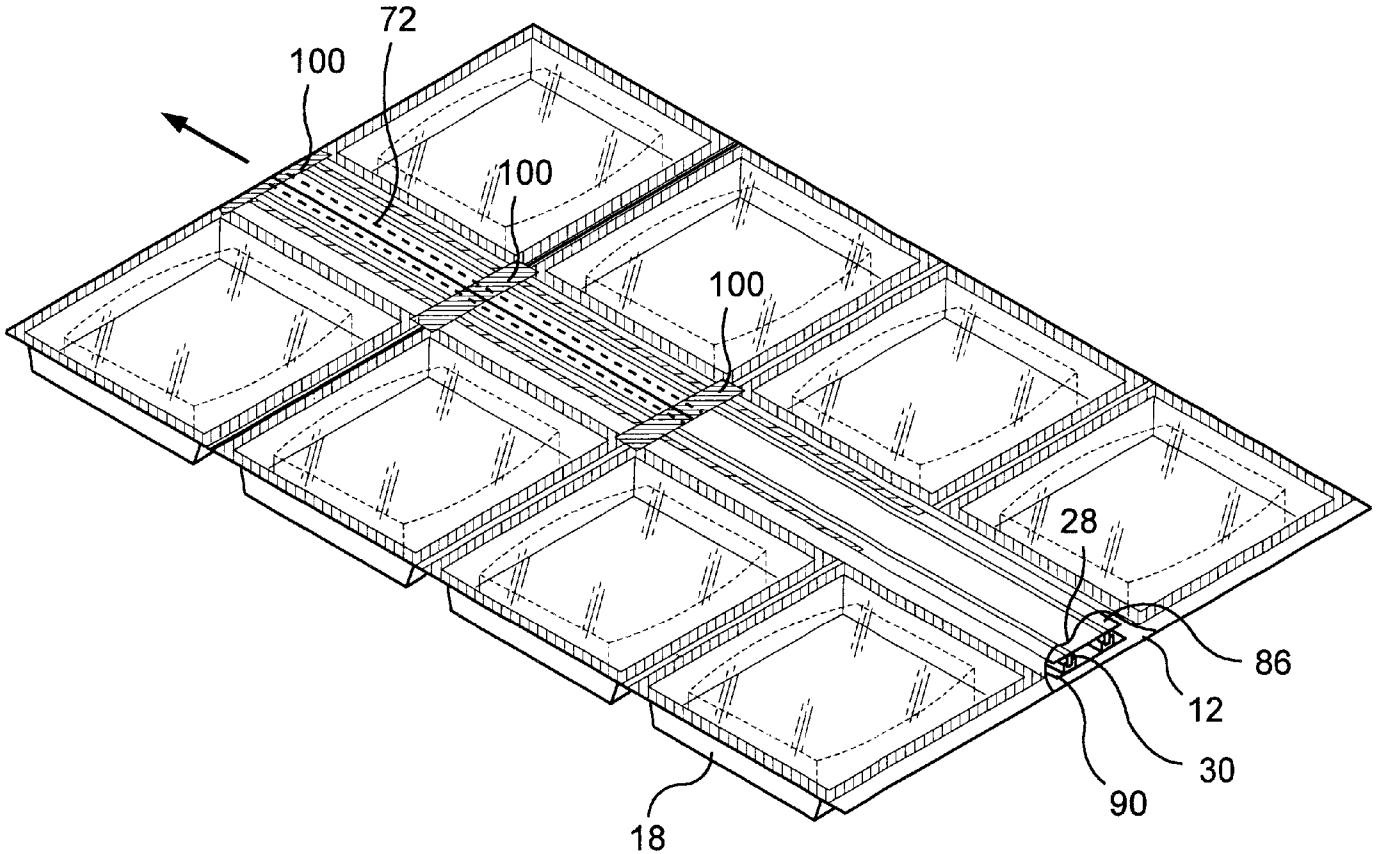

During the machine cycle when the sealing die 38 and 40 is closed, a vacuum is drawn through ports 62 in seal head shell 38 and ports 64 in the seal die shell 40. When a sufficient vacuum is drawn, air bladder 66 is constructed to actuate perimeter-type seal bar 68 against the spring return force of seal bar spring plate 70. This seals the package under vacuum conditions. Simultaneously and during the afore-described sealing activity, the impulse seal bar 54 tacks the double-track zipper blank 30 to the portions of the packaging film 12 and 28 lying between the adjacent walls 60 of the adjacent packages 36. The tacking seam 72, FIG. 5, becomes the tamper-indicating strip of the final package, see infra. The evacuation and sealing station 26 is of jacketed construction so that a thermal medium 74, FIG. 2, such as water, when introduced through ports 76 into cooling passages 78 maintain both the sealing and evacuation chambers 58 and the zipper channel 46 at the desired temperatures.

Figure 4:
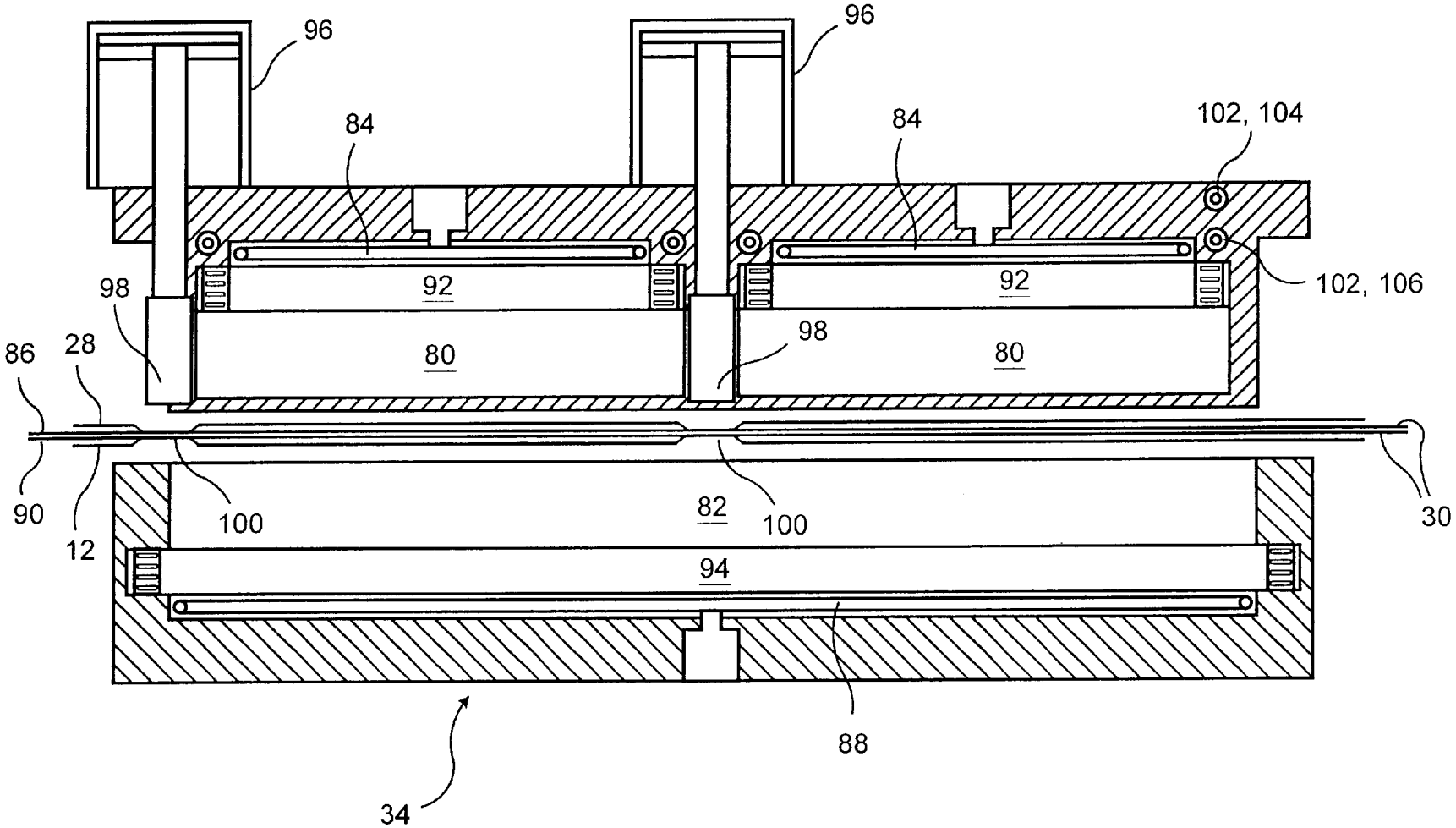
FIG. 4 is a cross-sectional view taken at the zipper welding station of the HVFFS packaging machine of FIG. 1, showing the longitudinal welding and transverse zipper welding units thereof; and, FIG. 5 is a top plan view of the packages formed on the HVFFS packaging machine of FIG. 1 showing the layout thereof prior to the cutting.

In the double-track HVFFS packaging machine shown herein, the perimeter sealed side-by-side packages with the zipper blank tacked thereto now advance to the welding and cutting station 34, the cross-sectional view of which is shown in FIG. 4. Here, the packages just described are received between the upper seal bar 80 and lower seal bar 82. During the machine cycle when the evacuation chamber 58 is closed, the upper seal bladders 84 actuate the upper seal bars 80 to longitudinally weld packaging film 28 to upper flange 86 of zipper blank 30. The programming of the welding unit 34 insures that sufficient thermal energy is supplied to weld the film to the blank without welding the upper zipper portion to the lower zipper portion.

Similarly and during the same machine cycle, the lower seal bar 82 is actuated by the lower seal bladder 88 and longitudinally welds packaging film 12 to lower flange 90 of zipper blank 30. After the welds are completed, the seal bars 80 and 82 are returned to the normal position by upper seal spring plate 92 and lower seal spring plate 94, respectively. During the same machine cycle end weld air cylinders 96 actuate end weld bars 98 to transversely seal the zipper ends 100. As seen in the sealing station 26, the welding station 34 is also of jacketed construction so that a thermal medium 102, such as water, when introduced through ports 104 into cooling passages 106 maintain the welding station temperature at a predetermined level.

The above invention is also pertinent to retrofitting existing horizontal form-fill-and-seal packaging machines. In the retrofit case, the sealing die is replaced with sealing and channel-forming die which enables, in a two-track packaging machine, the introduction of suitable zipper blanks between the package lines. For a one-track machine the zipper blank is introduced alongside and parallel to the package line. The retrofit conversion kit includes a zipper-blank feeder 31, FIG. 1, to supply zipper blank 30 to zipper channel 46. The sealing and channel-forming die includes an impulse sealing bar 54 and thermal-medium jacketed housing or shell 38. Added to the cutting station is the welding function as described in the preceeding paragraphs.

In operation, a zipper or reclosable seal is installed in the above-described horizontal vacuum form-fill-and-seal packaging machine in the following manner. With the sealing and channel-forming die 28 and 40 in the open position, the zipper blank 30 is fed from the zipper-blank feeder 31 through zipper aperature 48 ont zipper channel 46. Upon closure of the seal die, the lift rails 42 of the underlying lift station, raises seal die shell 40, which, in turn, grips the zipper blank 30 between the spring-loaded impulse bar 54 and the impulse seal gasket 52.

Besides the gripping action, the closure also isolates the zipper blank attachment operation from the vacuum (or modified atmosphere) packaging operation by mating perimeter gaskets 44 of the seal die shell 40 with the walls 60 of the seal head shell 38 and thereby completely enclosing evacuation chambers 58. After closure and isolation, the vacuum or the modifying of the atmosphere occurs programmatically with the time therefor varying considerably based on packaging specifications. This is generally between 0.5 and 30 seconds. In this time, the 3 mm impulse seal wires in the face of seal bar 54 are activated for approximately a 0.4-second interval. This provided sufficient thermal energy to tack packaging film 12 to lower flange of zipper blank 30, to tack together the lower flange and the upper flange of zipper blank 30, and to tack packaging film 28 to upper flange of zipper blank 30. This tacking is performed in a manner that the resultant film portion (located furthest away from the package) becomes a tamper-indicating tear-off strip. In this embodiment, during tacking, the lower web of packaging film at the impulse sealer is lifted 5 mm. above the level of the lower web of packaging film at the sealing die.

The tacking operation in the channel-forming die takes place under temperature controlled conditions and the thermal energy from the impulse operation is absorbed by the thermal medium in the jacketed construct or chiller described above. Thus, given the short duration of the impulse heating and process water in the chiller at, for example, 65° F., the return to ambient temperature in the zipper pathway 50 is almost instantaneous and, in this embodiment, occurs within twenty seconds of impulse sealing. To accomplish this, the thermal medium in the chiller is maintained at 65°±15° F. However, adjustments to the chiller can increase the cool-down time to one minute. Temperature controlling of the zipper attachment is significant because at elevated temperatures zipper blanks tend to twist and otherwise distort so that management thereof becomes problematic. After completion of the evacuation cycle, the sealing and channel-forming die opens and the vacuum packaged goods with the zipper blank attached thereto is indexed along the product path to the cutting and welding station.

It is possible to use the teachings of the present invention in applications other than the exemplary horizontal vacuum form-fill-and-seal packaging machine described in the invention above. It is, also suggested that the above is applicable with some modification to vertical and horizontal bagging machines in which only a single packaging film is used. Also the invention is applicable to rollstock machines which do not package goods under a vacuum or a modified atmosphere. Still other modifications will be obvious to a person skilled in the art, it being understood that the present invention is not limited to the particular construction disclosed and shown in the drawing. The invention further comprises modifications and equivalents within the scope of the claims.

Numerous advantages are obtained through the use of the present invention, especially the two-stage installation of the zipper blank into an HVFFS package. Additionally, package integrity is enhanced by the temperature control during the procedure and thereby reducing leakers that are commonplace when zippers are subjected to thermal variation during installation. The present invention also provides a means for retrofitting existing HVFFS packaging lines without zipper installation to HVFFS packaging lines with zipper installation. This is accomplished without changing the footprint of the machine or adding lift stations. Other benefits of the invention will become apparent from the review of the claims which follow.

What is claimed is:

1. A horizontal form-fill-and-seal (FFS) packaging machine having a forming station with a forming die functioning cooperatively with a first lift station to form product-receiving cavities in a lower web of packaging films, a product filling stations, and a sealing station with a sealing die functioning cooperatively with a second lift station to seal packages with an upper web of packaging film, said FFS packaging machine comprising:

a zipper blank feed means for providing between said lower web and said upper web a zipper blank to said sealing station;

at least one channel-forming die in said sealing die and isolated therefrom by a wall therebetween, each said channel-forming die, in turn comprising:

aperture-forming means for forming an aperture adapted to receive said zipper blank therewithin, said aperture being between said lower web of packaging film and said upper web of packaging film;

an impulse sealer in said channel-forming die adapted for longitudinally attaching, after introduction of said zipper blank into said aperture, said packaging films and said zipper blank; and, spring means in cooperative functional relationship with said second lifting device for lifting, during said sealing cycle, said packaging films to said impulse sealer and attaching said zipper blank to said packaging films;

whereby the packaging machine attaches the zipper to the packaging films while at the sealing station without requiring an additional lift station therefor.

2. A horizontal FFS packaging machine as described in claim 1, wherein said spring means in cooperative functional relationship with said lifting device raises said packaging film at said impulse sealer above the level of said packaging film at said sealing die.

3. A horizontal FFS packaging machine as described in claim 2 wherein said lower web of packaging film at said impulse sealer is lifted 5 mm. above the level of said lower web of packaging film at said sealing die.

4. A horizontal FFS packaging machine as described in claim 1 wherein said channel-forming die further comprises:

a chiller for dissipating thermal energy generated by impulse sealing and maintaining the zipper blank free from thermal shock during installation thereof.

5. A horizontal FFS packaging machine as described in claim 4 wherein the zipper blank returns to ambient room temperature within one minute of impulse sealing.

6. A horizontal FFS packaging machine as described in claim 5 wherein the zipper blank returns to ambient room temperature within 20 seconds of impulse sealing.

7. A horizontal FFS packaging machine as described in claim 4 wherein said chiller further comprises a thermal medium maintained at a temperature of 65°±15° F.

8. A horizontal FFS packaging machine as described in claim 7 wherein said thermal medium is recirculating cooling water.

9. A horizontal FFS packaging machine as described in claim 1 wherein said packaging machine is a vacuum packaging machine having, during dwell time at said sealing station, an evacuation and sealing cycle concurrent with which the zipper blank is longitudinally sealed.

10. A horizontal FFS packaging machine as described in claim 1 wherein said packaging machine is a modified atmosphere packaging machine having an atmosphere modification cycle wherein the zipper blank installation is concurrent with the atmosphere modification cycle thereof.

11. A working station for a form-fill-and-seal (FFS) packaging machine, said machine having a frame and means for conveying two layers of packaging film therealong from, an input side to an output side, said FFS packaging machine forming one or more tracks of packages, said working station comprising, in combination:

a shell for housing temperature-controlled operations;

at least one sealing die in said shell, each said sealing die completely sealing, during a controlled cycle time therefor, packages formed on one of said tracks of packages;

at least one channel-forming die in said shell and alongside said sealing die and isolated therefrom by a wall therebetween, each said channel-forming die, in turn comprising:

aperture-forming means for forming an aperture to receive a zipper blank therewithin, said aperture being between said two layers of packaging film;

an impulse sealer in said channel-forming die for impulse sealing, upon introduction of said zipper blank into said aperture, said two layers of packaging film and said zipper blank;

whereby the working station installs the zipper to the package during the controlled cycle time provided for the sealing of the package.

12. A working station as described in claim 11, wherein said working station further comprises a lifting device and said channel-forming die further comprises:

spring means in cooperative functional relationship with said lifting device lifting said packaging film at said impulse sealer beyond the level of said packaging film at said sealing die.

13. A working station as described in claim 12 wherein said packaging film at said impulse sealer is lifted 5 mm. beyond the level of said packaging film at said sealing die.

14. A working station as described in claim 11 wherein said channel-forming die further comprises:

a chiller in said shell for dissipating the energy of impulse sealing and maintaining the zipper blank free from thermal shock during installation thereof.

15. A working station as described in claim 14 wherein the zipper blank returns to ambient room temperature within one minute of impulse sealing.

16. A working station as described in claim 15 wherein the zipper blank returns to ambient room temperature within 20 seconds of impulse sealing.

17. A working station as described in claim 14 wherein said chiller further comprises a thermal medium maintained at a temperature of 65°±15° F.

18. A working station as described in claim 17 wherein said thermal medium is recirculating cooling water.

* * * * *